United States Patent [19]

Jachowski

[11] Patent Number: 5,065,119

[45] Date of Patent: Nov. 12, 1991

[54] NARROW-BAND, BANDSTOP FILTER

[75] Inventor: Douglas R. Jachowski, Redwood City, Calif.

[73] Assignee: Orion Industries, Inc., Solon, Ohio

[21] Appl. No.: 487,628

[22] Filed: Mar. 2, 1990

[51] Int. Cl.[5] ..... H01P 1/20

[52] U.S. Cl. ..... 333/202; 333/219.1; 333/235; 333/35

[58] Field of Search ..... 333/202, 204, 205, 219, 333/219.1, 235, 231, 212, 33, 35

[56] References Cited

U.S. PATENT DOCUMENTS

| | | | |
|---|---|---|---|
| 3,840,828 | 10/1974 | Linn et al. | 333/204 X |
| 4,468,644 | 8/1984 | Teague et al. | 333/35 X |
| 4,823,098 | 4/1989 | DeMuro et al. | 333/202 X |
| 4,862,122 | 8/1989 | Blair, Jr. et al. | 333/212 X |

FOREIGN PATENT DOCUMENTS

| | | | |
|---|---|---|---|
| 0141005 | 8/1983 | Japan | 333/204 |
| 0246101 | 12/1985 | Japan | 333/204 |

OTHER PUBLICATIONS

Schiffman et al., "Design Tables . . . Band-Stop Filter", IEEE Trans. on Microwave Theory & Tech., vol. MTT-14, No. 10, Oct. 1966, pp. 474–482.

"Waveguide Bandstop Elliptic Function Filters", by J. David Rhodes in the IEEE Transactions on Microwave Theory & Tech., Nov., 1972.

"Realization of Dual Mode Band Rejection Filters", by R. Snyder published in the 1979 Procedings of IEEE Microwave Theo. & Tech. pp. 264–268.

"Propagation Characteristics of a Partially Filled Cylindrical Waveguide for Light Beam Modulation" by D. Chen in the IEEE Trans. on Microwave the vol. MTT-14, No. 10, Oct. 1966, pp. 482, 483.

*Primary Examiner*—Eugene R. Laroche
*Assistant Examiner*—Seung Ham
*Attorney, Agent, or Firm*—Dressler, Goldsmith, Shore, Sutker & Milnamow

[57] ABSTRACT

A multi-resonant notch filter incorporates a stepped impedance transmission line with impedance values going from a relatively low value and increasing upward to a relatively high value then back down to a relatively low value again. A plurality of resonant cavitites is coupled to the relatively high central impedance line section of the filter. Other resonators can be coupled to lower impedance sections of the transmission line.

22 Claims, 10 Drawing Sheets

NARROW-BAND, BANDSTOP FILTER

FIELD OF THE INVENTION

The invention pertains to band reject, notch, filters. More particularly, the invention pertains to improved band reject filters realized using a plurality of resonators in combination with a variable impedance transmission line.

BACKGROUND OF THE INVENTION

Conventional RF and microwave narrow-band bandstop filters generally consist of a length of transmission line or waveguide to which multiple one-port bandstop resonators are coupled—either by direct contact, by probe, by loop, or by iris—at spacings of approximately an odd multiple of a quarter wavelength, usually either one quarter wavelength or three quarter wavelengths. The individual resonators are typically quarter-wavelength transmission line resonators or dielectric resonators.

It is also known to provide some means of tuning the frequency of the resonators, since manufacturing tolerances and material properties make resonator frequencies too unpredictable to guarantee optimum filter performance. Usually, the characteristic impedance of the transmission line is held constant along its length. Filters have been implemented utilizing stripline technology resulting from a design method which produces very specific impedance values in a stepped impedance transmission line. (Schiffman and Young, "Design Tables for an Ecliptic Function Band - Stop Filter", IEEE Vol. MTT-14 No. 101,966 page 474). Such designs, however, tend to suffer from a more complex configuration, stingent dimensional tolerances, unsuitability to narrow band applications and excessive panband losses.

With prior art narrow-band bandstop filters, the unloaded Q of all of the resonators must be maximized to achieve the best performance, while their level of coupling to the transmission line must be individually adjusted to obtain the best performance. Unfortunately, given a transmission line of constant impedance, the optimum values of these couplings may exceed the maximum achievable, or desirable, with a given coupling method. For a fixed number of resonators, the performance of the filter then becomes limited by the maximum achievable coupling rather than by maximum obtainable unload Q of the resonators. Under such circumstances, the optimum filter performance cannot be realized.

While equal-ripple stopband, constant-impedance transmission line notch filters are known, and given a maximum achievable or desirable level of coupling of the resonators to the transmission line, it would be desirable to achieve:

- similar or better performance (notch depth, selectivity, and bandwidth) with fewer resonators,
- greater notch selectivity (ratio of notch floor width to width between passband edges) with similar or better notch depth,
- and greater notch depth (greater level of band rejection) with similar or better notch selectivity.

In addition, from a manufacturing and installation point of view, it is desirable to achieve reduced sensitivity of each resonator's characteristic resonant frequency to the coupling mechanism which couples between the resonator and the transmission line. This would provide improved mechanical and temperature stability for the filters, better repeatability of electrical performance from device to device, and less interaction between the tuning of the coupling and the tuning of the resonant frequency of a resonator.

While constant impedance transmission line notch filters are known, it would be desirable to be able to achieve similar levels of performance but with fewer resonators. Further, it would be desirable to achieve greater notch depth, that is greater level of band rejection, with the same number of resonators as utilized in constant impedance transmission line notch filters with similar bandwidth and bandedge attenuation.

Further, it would be desirable to be able to create a variety of notch filters using a plurality of relatively standard elements such as resonators, transmission line segments and the like without having to create a large variety of specialized components which are only usable with a given filter design.

SUMMARY OF THE INVENTION

Notch filters in accordance with the present invention utilize a plurality of resonators and a stepped impedance transmission line. The transmission line has an input end and output end. Further, the line has a first selected, centrally located relatively high impedance value with at least some of the members of the plurality of resonators coupled to the line selectively spaced from one another.

Selective spacing of the resonators is on the order of an odd number of quarter wavelengths of the nominal center frequency of the filter. Thus, the resonators can be spaced one quarter wavelength from one another or three quarter wavelengths from one another.

Such filters also include first and second quarter wavelength impedance transforming sections with a first transformer section coupled to the input end of the transmission line and with the second transformer section coupled to the output end thereof. Each of the transformer sections has an impedance value which is less than the impedance value of the transmission line.

An input signal can be applied to the first impedance transformer and a load can be coupled to the second impedance transformer. The described notch filters provide high performance with a deep, through relatively narrow, attenuation region.

The resonators are stagger tuned to different frequencies in either increasing or decreasing frequencies along the filter.

A notch filter can be implemented with two or more resonant cavities, some of which will be spaced along a relatively high impedance transmission line. Others of the resonators may be spaced along the quarter wave impedance transformer sections, each of which has an impedance less than that of the transmission line. Still others may be spaced along input and output transmission line segments having yet lower impedance values.

The filters can be symmetrical about a center line and can be implemented with either a relatively straight transmission line segment or a folded transmission line segment which results in a smaller physical package.

Resonators are spaced along the relatively high impedance transmission line on the order of an odd number of quarter wavelengths. The innermost pair or pairs of resonators can be spaced on the order of one quarter wavelength or three, quarter wavelengths apart. Other resonator pairs can be spaced on the order of one or three quarter wavelengths apart.

The resonators can be implemented with cylindrical conducting housings and are adjustable for purposes of setting up and tuning the filter. The resonators include an adjustable coupling loop. Varying and increasing the impedance value of the transmission line through the interior region of the filter effectively increases the coupling to the respective resonators.

The resonators can be implemented with cylindrical conducting housings containing dielectric resonators and have adjustable characteristic resonant frequencies for purposes of setting up and tuning the filter. Increasing the value of the characteristic impedance of the transmission line through the interior region of the filter effectively increases the coupling to the respective resonators.

Numerous other advantages and features of the present invention will become readily apparent from the following detailed description of the invention and the embodiments thereof, from the claims and from the accompanying drawings in which the details of the invention are fully and completely disclosed as a part of this specification.

DETAILED DESCRIPTION OF THE PREFERRED EMBODIMENTS

Figure 1:
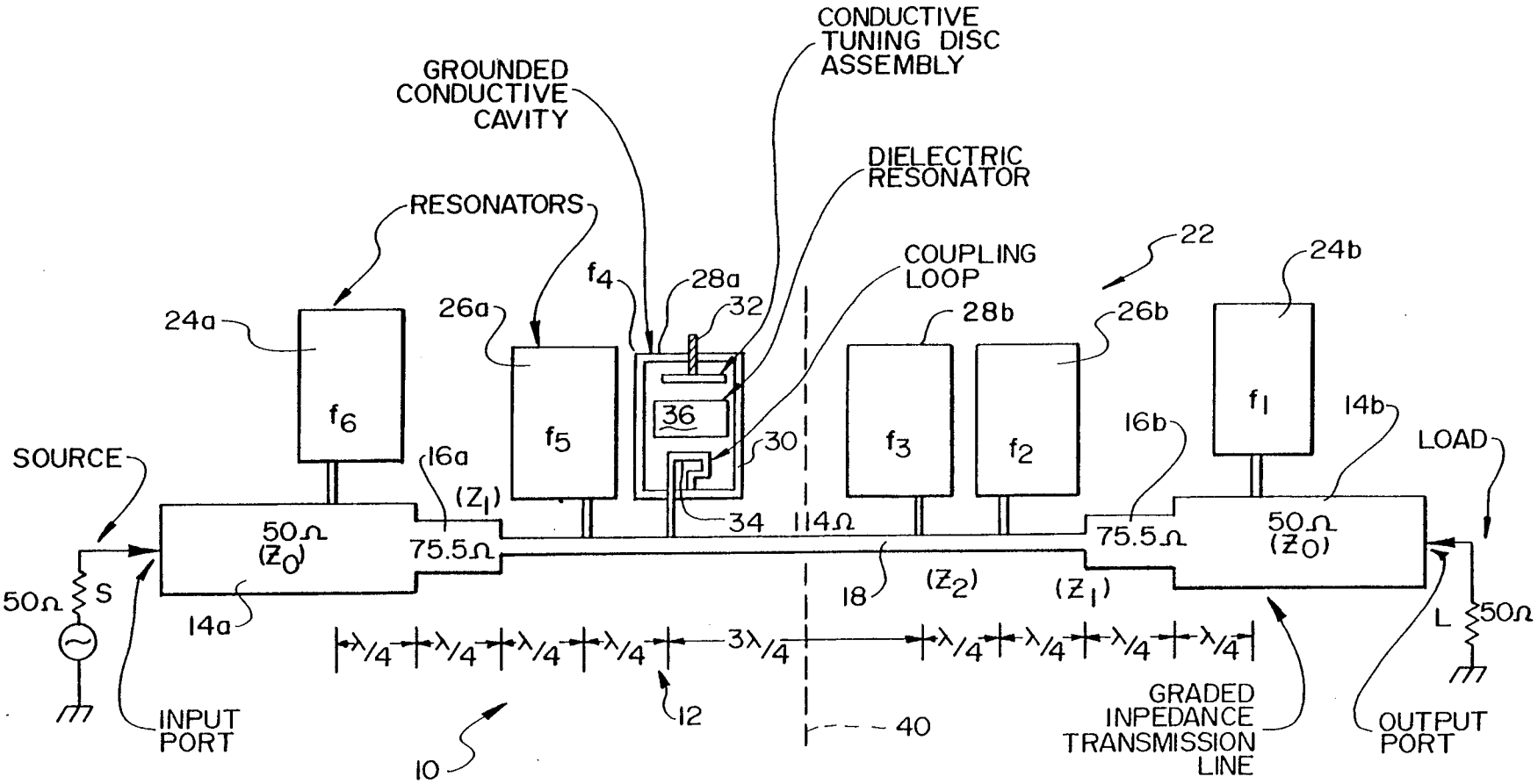
FIG. 1 is an overall block diagram of a filter in accordance with the present invention having six resonators.

While this invention is susceptible of embodiment in many different forms, there is shown in the drawing and will be described herein in detail specific embodiments thereof with the understanding that the present disclosure is to be considered as an exemplification of the principles of the invention and is not intended to limit the invention to the specific embodiment illustrated.

The present invention relates to a family of notch filters which have common structural characteristics. A stepped impedance, common transmission line provides a signal path between input and output ports of the filter.

A plurality of resonators is used for creation, in part, of the desired filter characteristics. At least some of the resonators are electrically coupled to a relatively high impedance section of the transmission line.

Coupled to each end of the relatively high impedance transmission line is a quarter wavelength impedance transformer. The impedance transformer sections have a lower impedance than the central section of the transmission line.

Input and output signals can be applied to and derived directly from the impedance transformer sections. Alternately, a low impedance transmission line section can be coupled to each of the quarter wave impedance transformers to match the source and load impedances.

Additional resonators can be coupled to the input and output transmission line sections to further improve and/or refine the filter performance characteristics.

With respect to FIG. 1, a notch filter 10 is illustrated. The filter 10, illustrated in block diagram form, can be coupled to a source S having, for example, a 50 ohm characteristic impedance and a load L having, for example, a 50 ohm impedance.

The filter 10 includes a stepped impedance, multi-element transmission line generally indicated at 12. The transmission line 12 includes 50 ohm input and output transmission line sections 14*a* and 14*b*.

Each of the 50 ohm sections 14*a* and 14*b* is in turn coupled to a quarter wave impedance transformer section 16*a* and 16*b*. Each quarter wave impedance transformer 16*a* and 16*b* has a characteristic impedance value which exceeds the impedance value of the input and output transmission line sections 14*a* and 14*b*.

A central, higher impedance transmission line section 18 is coupled between each of the impedance transformers 16*a* and 16*b*. The transmission line section 18 has, in the present instance, a characteristic impedance on the order of 114 ohms. The quarter wave transformer sections 16*a* and 16*b* each have a nominal impedance value on the order of 75.5 ohms (actual realized value was 71.2 ohms). The input and output transmission line sections 14*a* and 14*b* each have a standard nominal characteristic impedance of 50 ohms (actual realized value was 49.8 ohms).

A plurality of resonators 22 is coupled to various elements of the multi-impedance transmission line 12. For example, resonators 24*a* and 24*b* are each coupled to a respective input or output transmission line segment 14*a* or 14*b*. The resonators 24*a* and 24*b* are spaced one-quarter wavelength from the adjacent respective impedance transformer 16*a* or 16*b*.

Resonators 26*a* and 26*b* are coupled to the high impedance segment 18. Each of the resonators 26*a* and 26*b* is located one quarter wavelength away from the respective impedance transformer 16*a* or 16*b*.

Resonators 28*a* and 28*b* are also each coupled to the high impedance transmission line segment 18. The resonators 28*a* and 28*b* are each located one quarter wavelength away from the respective resonators 26*a* and 26*b* and are spaced from each other an odd number of quarter wavelengths.

Each of the resonators 24–28 consists of a high Q dielectric resonator 36 supported as is conventional with low loss dielectric within a conductive cylindrical housing 30, illustrated with respect to resonator 28. Each of the resonators includes an adjustable, conductive, frequency tuning disk assembly 32.

Further, each of the resonators includes an adjustable coupling loop 34 for coupling to the adjacent transmission line segment.

The coupling loop 34 can be rotated during set up and tuning to obtain the amount of coupling which optimizes filter performance. The coupling loop 34 has an axis which is lined up with an edge of the resonator 36.

The transmission line 12 includes an outer, hollow conductor which could have a square or rectangular cross section and a wire inner conductor. The inner conductor is supported along its length. Support can be provided either by a dielectric material, such as TEFLON or REXOLITE which can also be used to set the impedance value of a section or by thin dielectric spaces when the desired impedance and geometry of the line call for air as the dielectric material.

The characteristic impedance value of each of the various sections such as 14*a*, 14*b*, 16*a*, 16*b* and 18 is established by adjusting the dimensions of the inner and outer conductors as well as the dielectric constant and dimensions of the supporting material in each of those sections. The values of each of the respective impedances are approximately related in accordance with the following well known equation:

$$Z_1^2 = Z_0 * Z_2$$

The filter 10, it should be noted is symmetric about a center line 40. The resonators are stagger tuned in ascending or descending order to achieve the desired overall filter performance.

It will be understood that while the above values are preferred that physical realizations of the filter 10 may result in variations from the indicated values. One advantage of the structure of filter 10 is that over-all filter performance is not significantly impacted by such variations since resonators 24–28 are adjustable.

The resonators are stager tuned in ascending or descending frequency order to achieve the desired overall filter performance. In filter 10, resonator 24*a* is tuned to the highest stopband frequency F6 while resonator 26*a* is tuned to the next lower frequency F5, and so on, with resonator 24*b* tuned to the lowest stop band frequency, F1. Just as the resonators are symmetrically placed about the physical centerline of the filter, the frequencies that the respective cavities are tuned to tend to be approximately symmetric about the center frequency of the filter, as is evident in the graphs of the measured filter frequency response.

Figure 2:
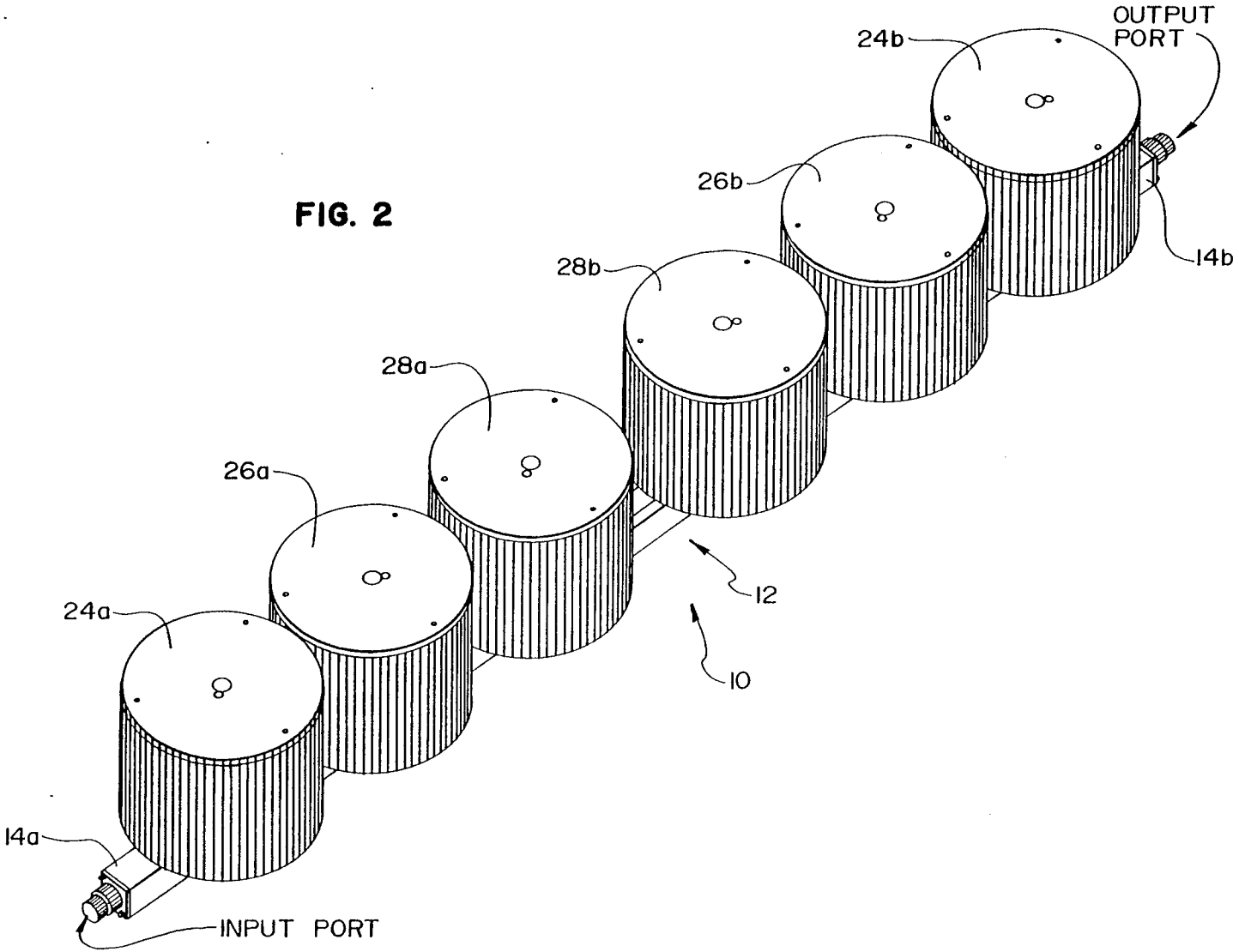
FIG. 2 is a perspective mechanical view of the filter of FIG. 1.

FIG. 2 is a perspective view of the filter 10 illustrating relative placement of the resonators 24–28 along the stepped impedance transmission line 12. As illustrated in FIG. 2, the filter 10 utilizes an essentially straight transmission line 12.

Each of the resonators in the filter 10 has a diameter on the order of 5.5 inches. The total overall filter length from input port to output port is on the order 38.5 inches.

The filter 10 has been designated to have a −20 dB stopband bandwidth of 1.0 MHz centered between passband −0.8 dB band edges at 845 MHz and 846.5 MHz. In addition, it has been designed to have an insertion loss of less than 0.3 db at 835 MHz and 849 MHz.

Figure 3A:
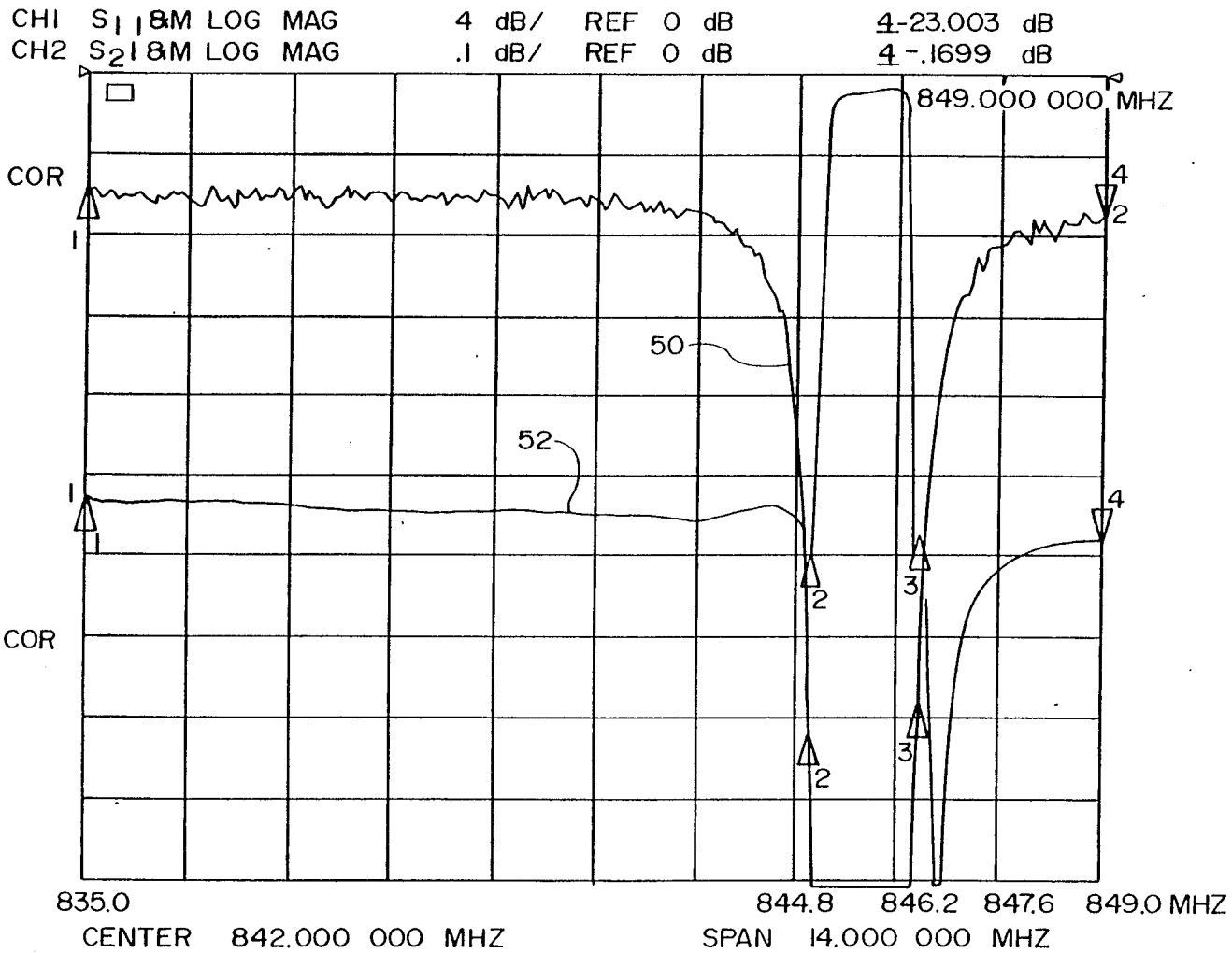
FIG. 3A is a graph illustrating relatively broadband frequency characteristics of the filter of FIG. 1.

FIG. 3A is a graph 50 illustrating the measured gain (S21) of a physical realization of the filter 10 as in FIG. 2 over a 14 MHz bandwidth from 835 MHz to 847 MHz. Each horizontal division of the graph 50 of FIG. 3 corresponds to 1.4 MHz while each vertical division corresponds to 0.1dB.

As illustrated by the graph 50, the filter 10 exhibits a highly selective notch in its frequency characteristic in the 845 to 846.5 MHz range.

A second graph 52 on FIG. 3 illustrates the input return loss (S11) of the filter 10 over the same frequency range. Each vertical division for the graph 52 corresponds to 4dB.

Figure 3B:
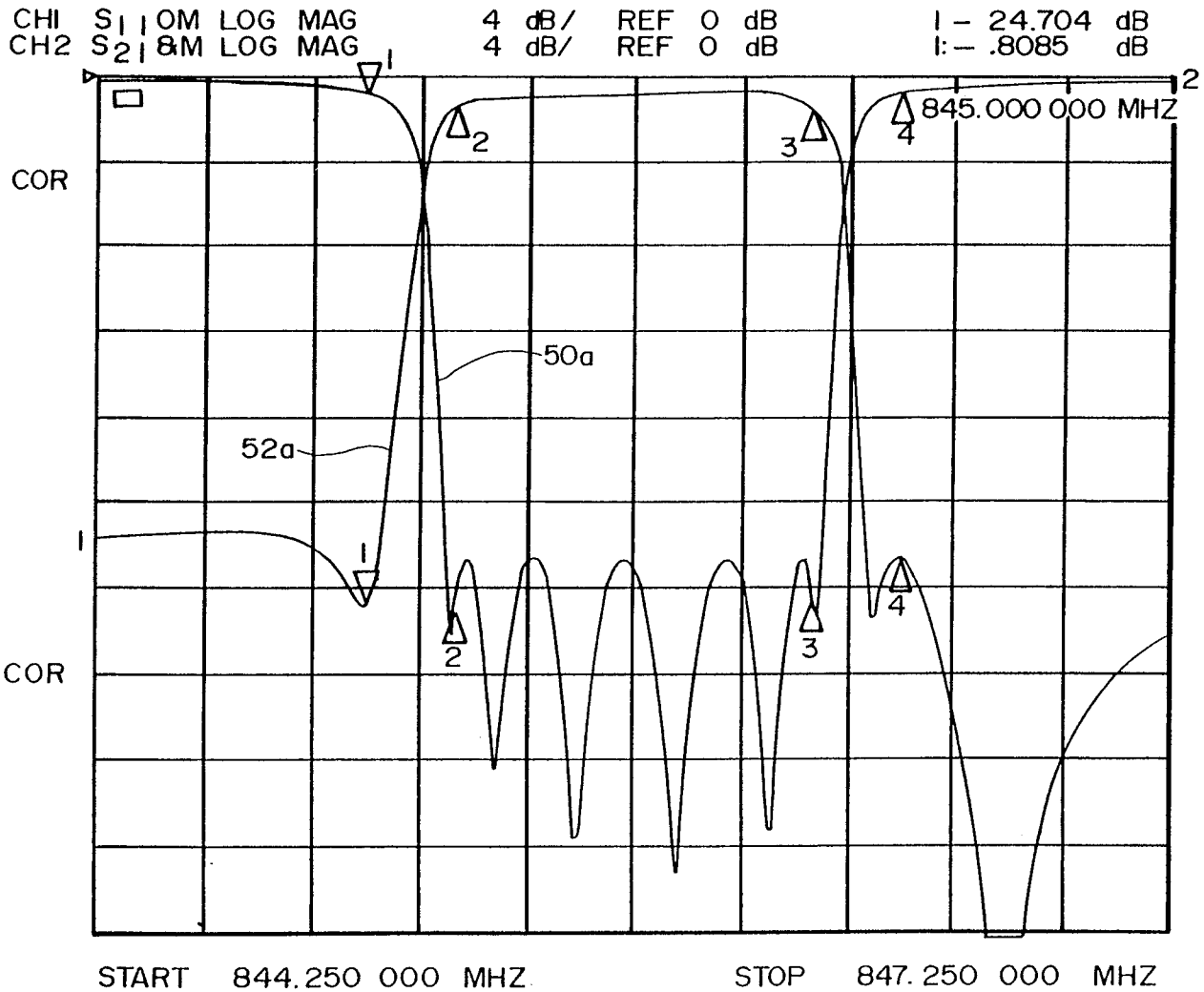
FIG. 3B is a second graph illustrating relatively narrow band characteristics of the filter of FIG. 1.

FIG. 3B illustrates in detail the notch characteristic of the filter 10. A graph 50*a* is the gain of the filter 10 over an 844.25 to 847.25 MHz bandwidth. Each vertical division of FIG. 3B corresponds to 4dB. Graph 52*a* is the input return loss for the filter 10 over the same frequency range.

Again with respect to the filter 10 of FIG. 2, the overall cross sectional shape of the transmission line 12 is square with exterior dimensions on the order of 1″×1″.

Figure 4:
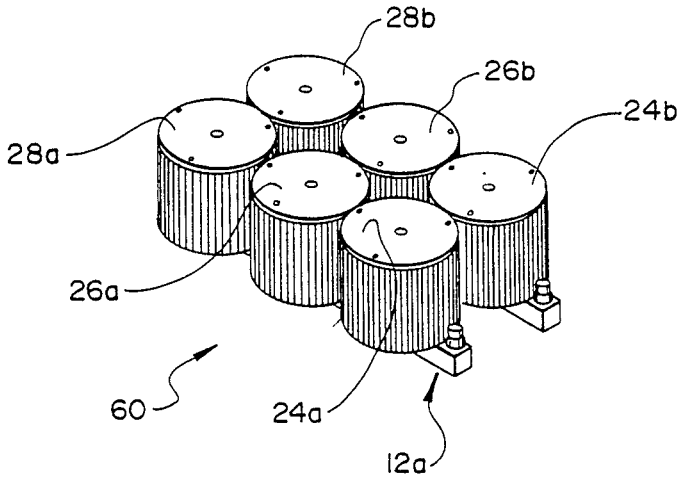
FIG. 4 is a perspective view of an alternate embodiment of the filter of FIG. 1.

FIG. 4 illustrates an alternate six resonator configuration 60. The filter 60 has a block diagram which corresponds to the block diagram of FIG. 1 and has the same number of resonators. Each resonator has the same basic configuration as in the filter 10.

The filter 60 is folded and is physically smaller lengthwise than the filter 10. The filter 60 includes a folded multi-stepped transmission line 12*a*, having stepped impedances corresponding to the impedances of the transmission line 12. However, the transmission line 12*a* has a rectangular cross-section with the height of ⅜ of an inch and a width of one inch. It can be formed by milling out a channel in an aluminum block.

Figure 5A:
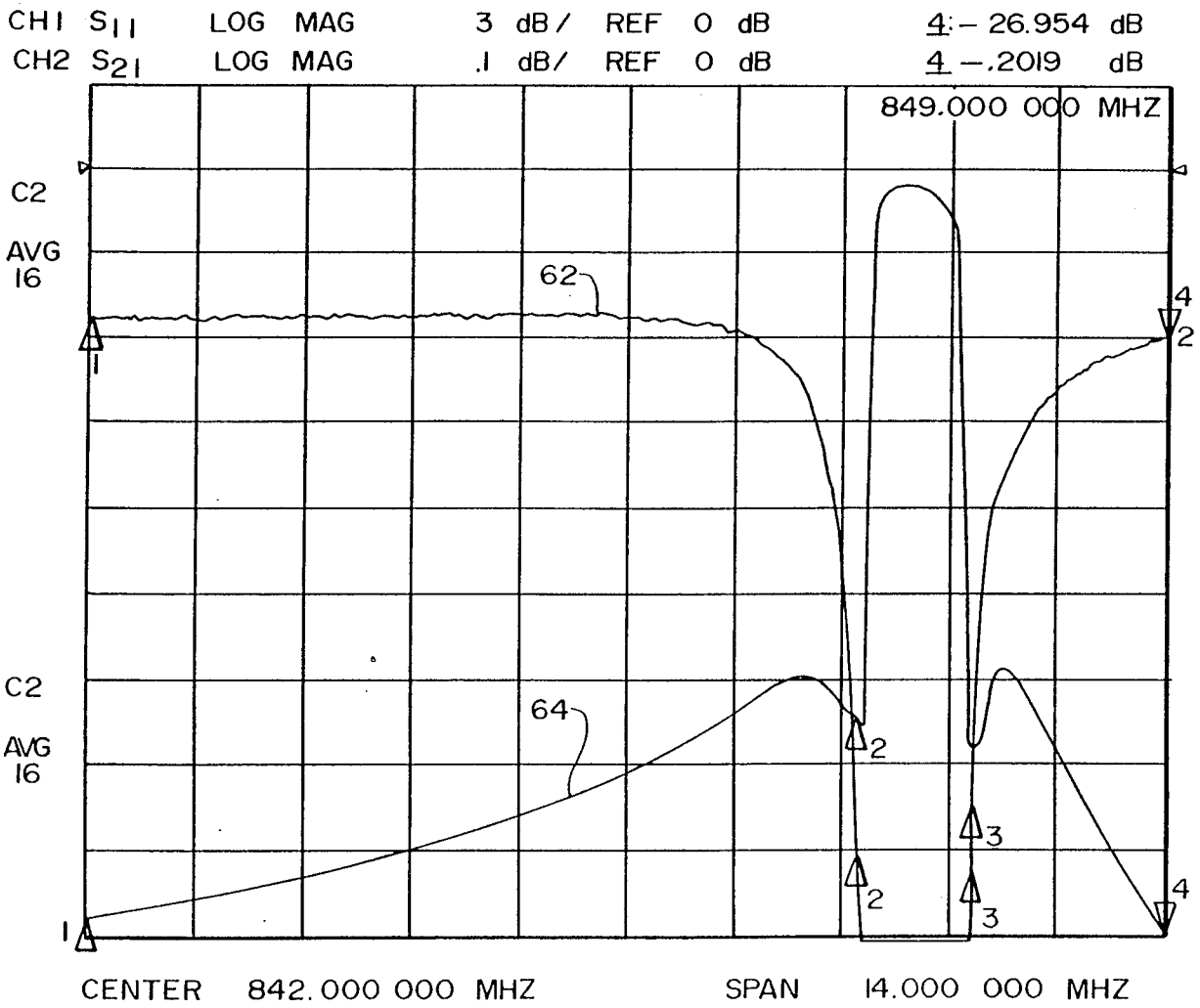
FIG. 5A is a graph illustrating frequency characteristics of the filter of FIG. 4.
Figure 5B:
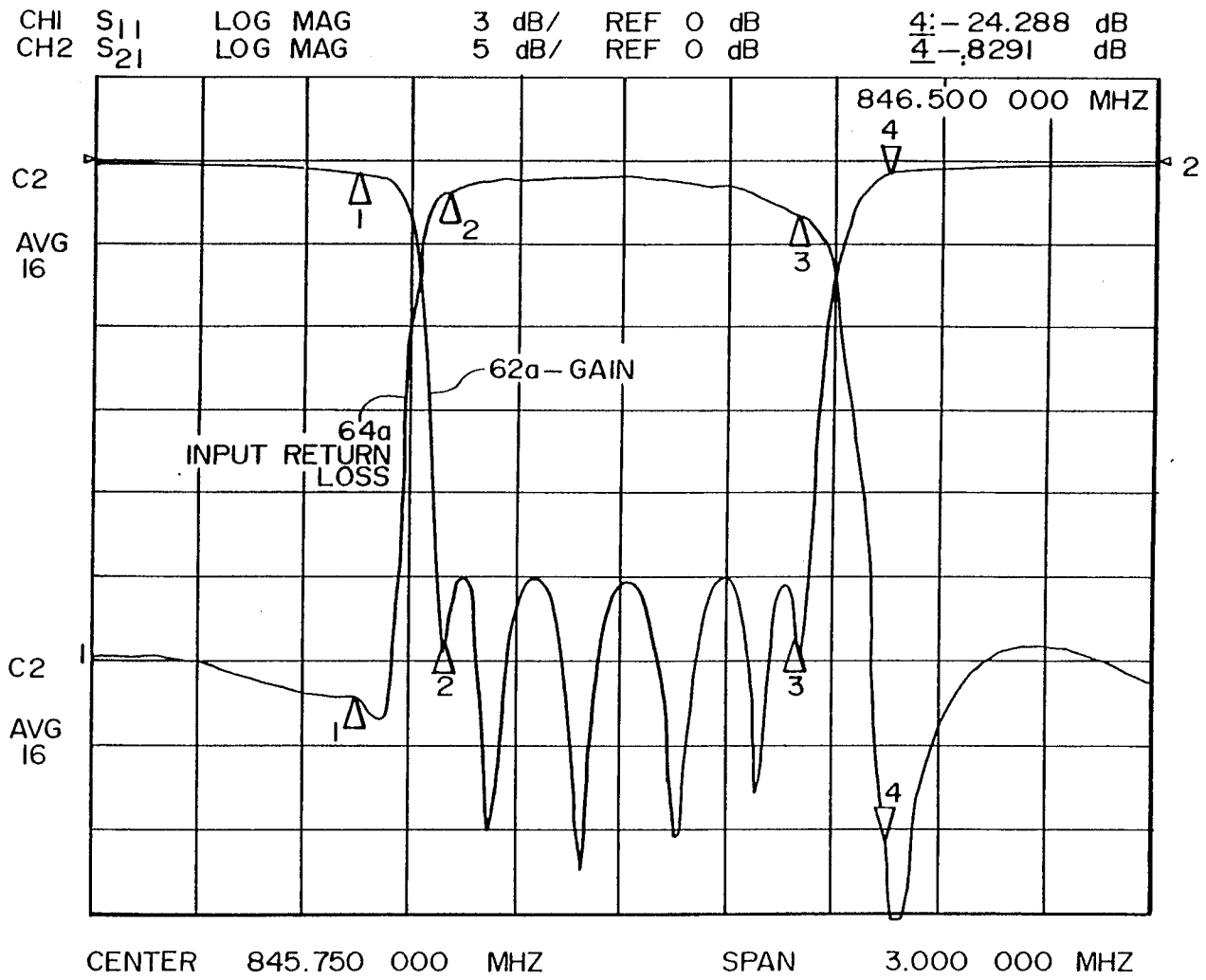
FIG. 5B is a second graph illustrating relatively narrow band characteristics of the filter of FIG. 4.

FIG. 5A is a plot corresponding to that of FIG. 3A illustrating the filter gain (S21) versus frequency response 62 of the filter 60 as well as the input return loss 64 over the same frequency range 835 MHz to 849 MHz as in FIG. 3A. The vertical scale for the return loss 64 is 0.1 dB/division, while the vertical scale for the insertion loss 62 is 3 dB/division. FIG. 5D illustrates the notch characteristic of filter 60 with horizontal divisions as in FIG. 3B. The insertion loss vertical scale is 5 dB/division and the return loss vertical scale is 3 dB/division.

The folded filter 60 is on the order of 18.25 inches long and 11.0 inches wide.

Figure 6:
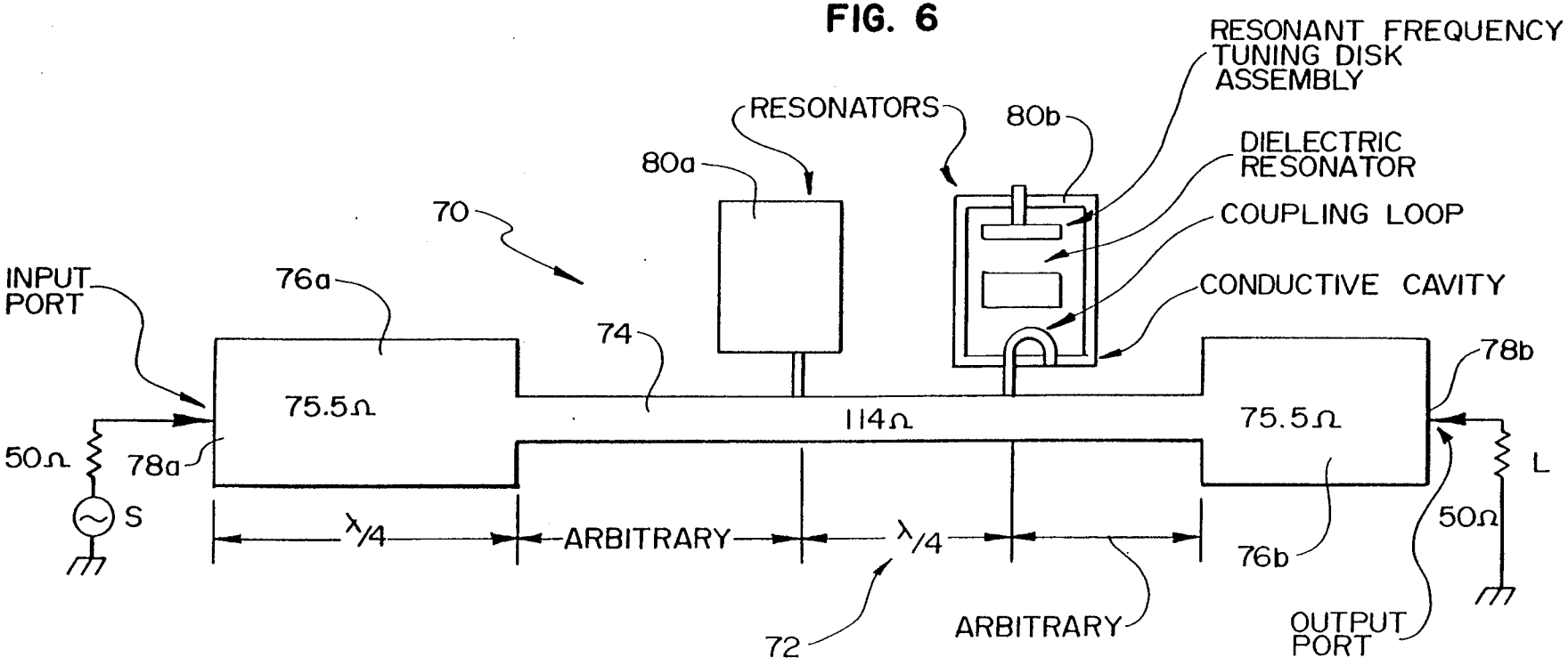
FIG. 6 is an overall block diagram of a filter having two resonators.

FIG. 6 is a block diagram of a two resonator filter 70. The filter 70 includes a stepped impedance transmission line 72 with a relatively high impedance central section 74 which is connected at each end thereof to quarter wave impedance transformers 76*a* and 76*b*. The filter 70 can be fed at an input port 78*a* from a source S of characteristic impedance $Z_{os}$ (for example 50 ohms) and will drive a load L of impedance $Z_{ol}$ (for example 50 ohms) from an output port 78*b*.

The filter 70 also includes first and second resonators 80*a* and 80*b* which are of the same type of resonators previously discussed with respect to the filter 10. The resonators 80*a* and 80*b* are coupled to the high impedance transmission line section 74 and are spaced from one another by one quarter wavelength of the center frequency of the filter 70.

The filter 70 provides a −18dB deep, 200 KHz wide wide notch in a frequency band 849.8 to 850.0 MHz with less than 0.3 dB insertion loss at 849 MHz.

Figure 7:
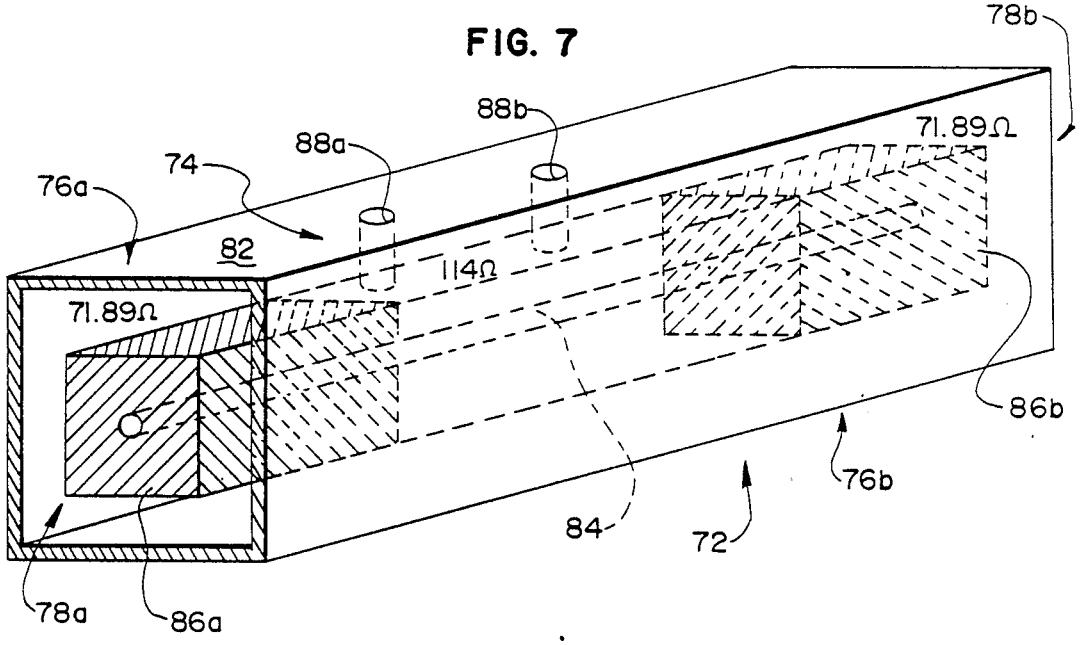
FIG. 7 is a perspective view, partly broken away, of the stepped impedance line of the filter of FIG. 6.

FIG. 7 is a perspective view partly broken away of the transmission line 72 of the filter 70. The transmission line 72 has a generally square cross-section with an outer metal housing 82 with dimensions on the order of 1″×1″. The housing 82 could be formed for example of aluminum.

An interior conductor 84 extends within the exterior metal housing 82 and has a circular cross section. The conductor 84 can be formed of copper-clad steel wire for example.

The interior conductor 84 is supported by dielectric members 86*a* and 86*b*, each of which also has a square cross-section. The metal housing 74 includes first and second ports 88*a* and 88*b* which receive an elongated coupling member from a resonator coupling loop, such as the coupling loop 34.

The overall length of the transmission line 72 is on the order of 11½ inches with the high impedance region 74 having a length on the order of 7 inches and an impedance Z2 on the order of 114 ohms. The two quarter wavelength impedance transforming sections 76*a* and 76*b* each have a length on the order of 2.2 inches.

The impedance transforming sections 76*a* and 76*b* each include a dielectric material available under the trademark REXOLITE. The impedance Z1 of realized versions of the section 76*a* and 76*b* is on the order of 71 ohms as opposed to the design value of 75.4 ohms.

Figure 8:
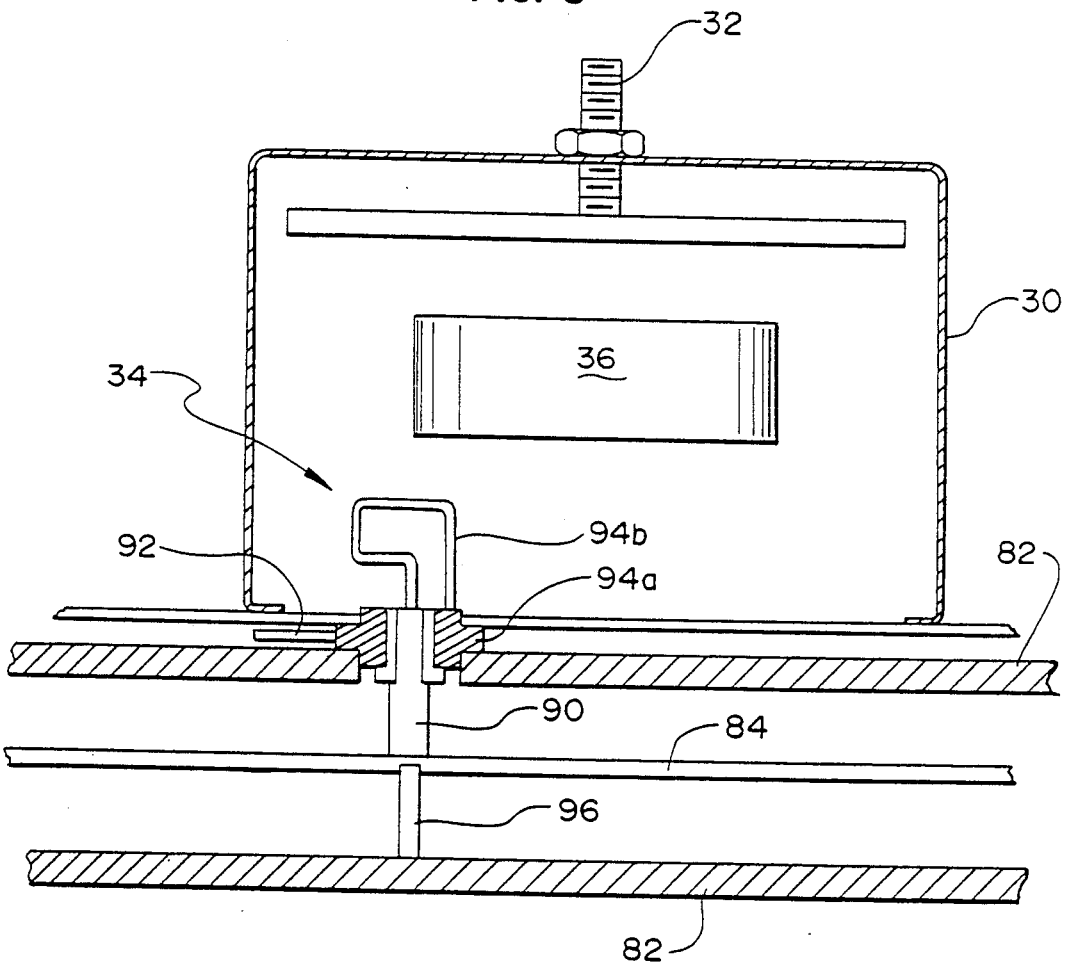
FIG. 8 is an enlarged partial view, partly in section, illustrating details of the resonator coupling loop.

FIG. 8 illustrates one of the adjustable coupling loops 34 which has an elongated cylindrical coupling member (a conductive metal post) 90 which is in electrical contact with the central conductor 84. As illustrated in FIG. 8, the coupling loop 34 is adjustable via a manually moveable handle 92 for purposes of adjusting the coupling to the respective resonator.

The post 90 of the loop 34 is insulated from the collar 94*a* by a REXOLITE sleeve. Adjustment of the coupling loop takes place by rotating metal collar 94*a*, attached to handle 92, which is in turn soldered to a portion 94*b* of the coupling loop 34. The collar 94*a* is in electrical contact with the outer metal conductor 82 and with the resonators metal housing 30. A teflon support 96 is provided beneath the rotatable member 90, for supporting the inner conductor 84 below the coupling post 90.

Figure 9:
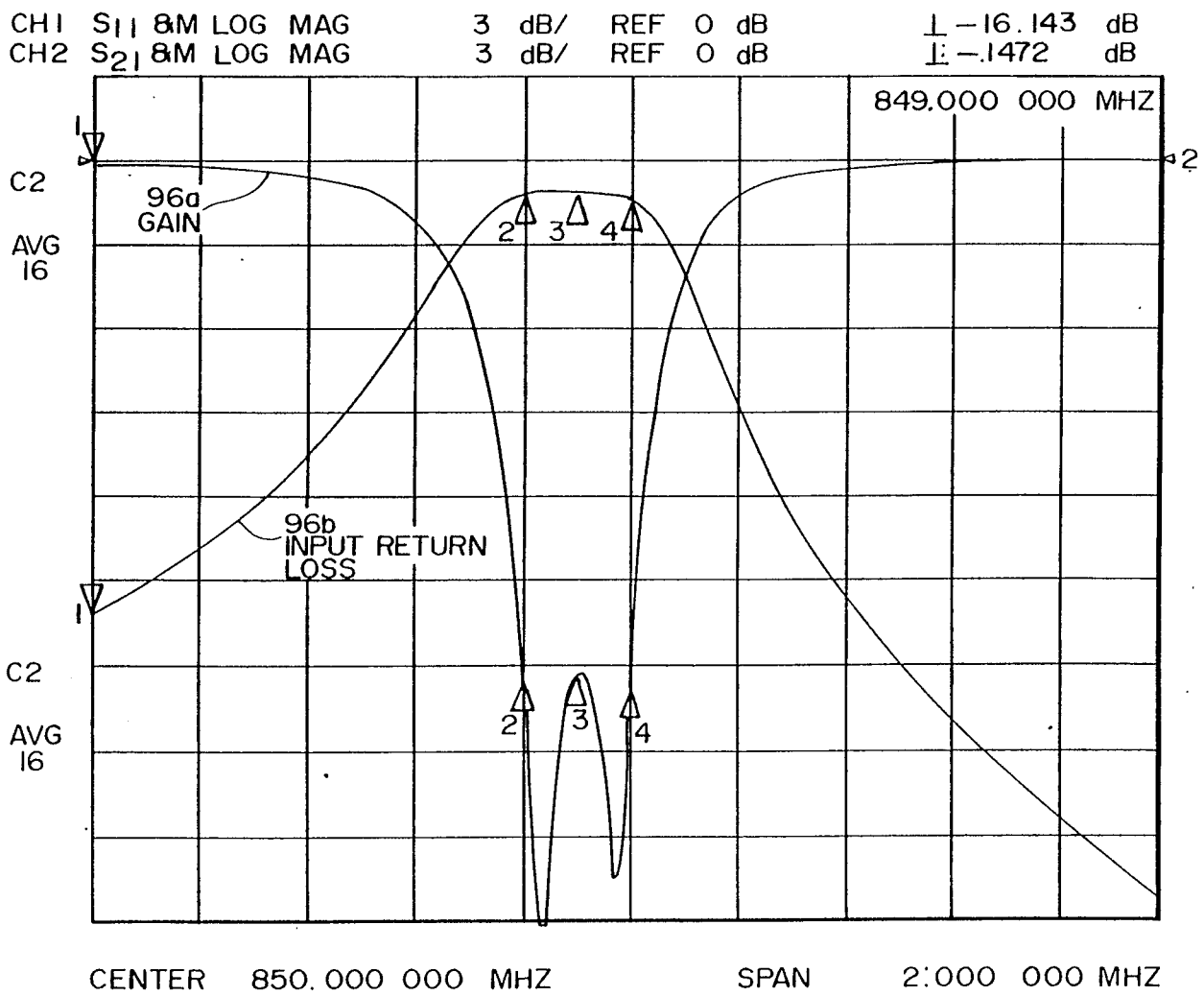
FIG. 9 is a graph illustrating frequency characteristic of the filter of FIG. .

FIG. 9 includes a graph 96*a* of the gain of the filter, 70 and a graph 96*b* of the input return loss of the filter. FIG. 9 has a 2MHz horizontal extent with each division corresponding to 3dB.

It will be understood that either an odd number or an even number of resonators can be used without departing from the spirit and scope of the present invention.

From the foregoing, it will be observed that numerous variations and modifications may be effected without departing from the spirit and scope of the novel concept of the invention. It is to be understood that no limitation with respect to the specific apparatus illustrated herein is intended or should be inferred. It is, of course, intended to cover by the appended claims all such modifications as fall within the scope of the claims.

What is claimed is:

1. A filter comprising:

a plurality of substantially identical tunable, dielectric resonators;

a transmission line with an input end and an output end, said line having a first selected impedance value with at least some members of said plurality of resonates coupled thereto and selectively spaced from one another, and from said ends, on said transmission line; and first and second impedance transformers with said first transformer coupled to said input end and with said second transformer coupled to said output end, each said transformer having an impedance value less than said first impedance value.

2. A filter comprising:

a plurality of substantially identical resonators;

a transmission line with an input end and an output end, said line having a first selected impedance value with at least some members of said plurality of resonators coupled thereto and selectively spaced from one another, and from said ends, on said transmission line;

first and second impedance transformers with said first transformer coupled to said input end and with said second transformer coupled to said output end, each said transformer having an impedance value less than said first impedance value; and including second and third transmission line segments each having an impedance value less than said transformer impedance value with each said segment coupled to one of said impedance transformers.

3. A filter as in claim 1 useable over a selected frequency band with a center frequency having an associated wavelength wherein said resonators coupled to said transmission line are spaced from one another an odd number of quarter wavelengths.

4. A filter as in claim 1 with said transmission line extending from said input end to said output end in a substantially straight line.

5. A filter comprising:

a plurality of substantially identical resonators;

a transmission line with an input end and an output end, said line having a first selected impedance value with at least some members of said plurality of resonators coupled thereto and selectively spaced from one another, and from said ends, on said transmission line;

first and second impedance transformers with said first transformer coupled to said input end and with said second transformer coupled to said output end, each said transformer having a impedance value less than said first impedance value; and with said transmission line folded into a predetermined shape.

6. A filter as in claim 1 useable over a selected frequency band with a center frequency having an associated wavelength wherein said impedance transformers are substantially identical and each has a length on the order of an odd number of quarter wavelengths.

7. A filter as in claim 3 having first and second resonators spaced from one another, on said transmission line on the order of one quarter wavelength.

8. A filter useable over a selected frequency band with a center frequency having an associated wavelength comprising:

a plurality of substantially identical resonators;

a transmission line with an input end and an output end, said line having a first selected impedance value with at lest some members of said plurality of resonators coupled thereto and selectively spaced from one another, and from said ends, on said transmission line;

first and second impedance transformers with said first transformer coupled to said input end and wit said second transformer coupled to said output end, each said transformer having an impedance value less than said first impedance value wherein said resonators coupled to said transmission line are spaced from one another an odd number of quarter wavelengths; and having first and second resonators spaced from one another, on said transmission line on the order of three, quarter wavelengths.

9. A filter as in claim 8 with third and fourth resonators spaced from said first and second resonators, on said transmission line, on the order of one quarter wavelength.

10. A notch filter with two substantially identical sections comprising:

a first section with a first transmission line segment having first and second transmission line ends and a first impedance;

at least one tunable dielectric resonator electrically coupled to said line spaced from said second end;

a quarter wavelength transformer section with an impedance value lower than said first impedance coupled to said first end and spaced from said resonator; and a second section, identical to said first section with said second transmission line ends electrically coupled together with each said dielectric resonator tuned to a different frequency.

11. A two section notch filter as in claim 10 with each said section including at least another resonator electrically couple to said line, spaced from said one resonator by one quarter wavelength.

12. A two section notch filter as in claim 10 with said resonators in said two sections spaced from one another an odd number of quarter wavelengths.

13. A notch filter with two substantially identical sections comprising:

a first section with a first transmission line segment having first and second transmission line ends and a first impedance;

at least one tunable resonator electrically coupled to said line spaced from said second end;

a quarter wavelength transformer section with an impedance value lower than said first impedance coupled to said first end and spaced from said resonator;

a second section, identical to said first section with said second transmission line ends electrically coupled together with each said resonator tuned to a different frequency; and with each said section including a second transmission line section coupled to said transformer section, said second transmission line section having an impedance less than said transformer section impedance.

14. A two section notch filter as in claim 13 with each said section including a resonator coupled to said second transmission line section.

15. A two section notch filter as in claim 10 with said first transmission line segment formed in a substantially straight line.

16. A notch filter with two substantially identical sections comprising:

a first section with a first transmission line segment having first and second transmission line ends and a first impedance;

at least one tunable resonator electrically coupled to said line spaced from said second end;

a quarter wavelength transformer section with an impedance value lower than said first impedance coupled to said first end and spaced from said resonator;

a second section, identical to said first section with said second transmission line ends electrically coupled together with each said resonator tuned to a different frequency; and with said first transmission line segment formed with a substantial bend therein.

17. A filter as in claim 1 with said plurality including an odd number of resonators.

18. A filter as in claim 1 with said plurality including an even number of resonators.

19. A notch filter comprising:

a stepped impedance common communication line having an input region, an output region and a center coupling region, each said region having a predetermined impedance value with said input and said output regions each having substantially equal impedance values less than said center coupled in region impedance values; and a plurality of substantially identical tunable dielectric resonators with at least some of said resonators coupled to said center region, spaced from said input and said output regions, with others of said resonators coupled to said input and said output regions, spaced from said center region, and at least some of said resonators tuned to different frequencies than others.

20. A filter as in claim 19 usable at a selected frequency with an associated wavelength and having first and second resonators coupled to said center region spaced from a respective one of said input and said output regions a distance on the order of an odd number of quarter wavelengths.

21. A filter as in claim 29 usable at a selected frequency with an associated wavelength and having first and second resonators coupled respectively to said input and output regions spaced from said center region a distance on the order of an odd number of quarter wavelengths.

22. A filter as in claim 19 usable at a selected frequency with an associated wavelength and having first and second resonators coupled to said center region spaced from one another on the order of an odd number of quarter wavelengths.

* * * * *

UNITED STATES PATENT AND TRADEMARK OFFICE

CERTIFICATE OF CORRECTION

PATENT NO. : 5,065,119

DATED : November 12, 1991

INVENTOR(S) : Douglas R. Jachowski

It is certified that error appears in the above-identified patent and that said Letters Patent is hereby corrected as shown below:

Col. 8, line 53 , "wit" should be --with--.
Col. 8, line 30 , "a" should be --an--.
Col. 9, line 16, "couple" should be --coupled--.
Col. 10, line 42, "29" should be --19--.

Signed and Sealed this

Twenty-seventh Day of April, 1993

*Attest:*

MICHAEL K. KIRK

*Attesting Officer*

*Acting Commissioner of Patents and Trademarks*